US011306446B2

(12) United States Patent
Hartmann et al.

(10) Patent No.: US 11,306,446 B2
(45) Date of Patent: Apr. 19, 2022

(54) HAND-HELD WORK TOOL WITH DECOUPLED DRAWBAR CARRIER

(71) Applicant: Wacker Neuson Produktion GmbH & Co. KG, Reichertshofen (DE)

(72) Inventors: Robert Hartmann, Munich (DE); Andreas Bartl, Wörth (DE); Martin Simon, Schöpstal (DE); Ferdinand Rupp, Munich (DE)

(73) Assignee: Wacker Neusen Produktion GmbH & Co. KG, Reichertshofen (DE)

( * ) Notice: Subject to any disclaimer, the term of this patent is extended or adjusted under 35 U.S.C. 154(b) by 66 days.

(21) Appl. No.: 16/849,137

(22) Filed: Apr. 15, 2020

(65) Prior Publication Data

US 2020/0332481 A1 Oct. 22, 2020

(30) Foreign Application Priority Data

Apr. 16, 2019 (DE) ..... 102019110041.0

(51) Int. Cl.

| | |
|---|---|
| ***E01C 19/38*** | (2006.01) |
| ***E01C 19/40*** | (2006.01) |
| ***E01C 21/00*** | (2006.01) |
| ***E02D 3/074*** | (2006.01) |
| *B06B 1/16* | (2006.01) |

(52) U.S. Cl.
CPC ..... *E01C 19/402* (2013.01); *E01C 19/38* (2013.01); *E01C 21/00* (2013.01); *E02D 3/074* (2013.01); *B06B 1/16* (2013.01)

(58) Field of Classification Search
CPC ..... E01C 19/402; E01C 19/38; E01C 21/00; E02D 3/074; B06B 1/16
USPC ..... 404/113, 133.05–133.2
See application file for complete search history.

(56) References Cited

U.S. PATENT DOCUMENTS

| | | | | |
|---|---|---|---|---|
| 7,174,970 | B2 * | 2/2007 | Kremer | E01C 19/283 173/48 |
| 8,602,680 | B2 * | 12/2013 | Fischer | E01C 19/38 404/133.1 |
| 2009/0035065 | A1 * | 2/2009 | Gavins | E02D 3/074 404/114 |

(Continued)

FOREIGN PATENT DOCUMENTS

| | | |
|---|---|---|
| CN | 107354849 | 11/2017 |
| DE | 19828600 | 1/2000 |

(Continued)

*Primary Examiner* — Raymond W Addie
(74) *Attorney, Agent, or Firm* — Boyle Fredrickson S.C.

(57) ABSTRACT

A hand-held power tool has a lower mass and an upper mass. The lower mass has a tool and a working device for causing the tool to effect a work movement. The upper mass is movable relative to the lower mass and has a drive motor for the working device. A first vibration decoupling device is arranged between the lower mass and the upper mass for decoupling the upper mass from the lower mass in terms of vibration. A guide drawbar guides is provided for guiding the work tool by an operator. An electrical energy storage provides electrical energy for starting the drive motor. A drawbar carrier is carried by the upper mass and is connected to the upper mass via a second vibration decoupling device. The guide drawbar is attached to the drawbar carrier, and the energy storage is carried by the drawbar carrier.

14 Claims, 4 Drawing Sheets

(56) References Cited

U.S. PATENT DOCUMENTS

| | | | | |
|---|---|---|---|---|
| 2013/0243526 | A1* | 9/2013 | Williamson | F16F 15/08 404/133.1 |
| 2016/0108987 | A1* | 4/2016 | Williamson | A47L 11/4072 404/133.1 |
| 2019/0078282 | A1* | 3/2019 | Steffen | B06B 1/161 |
| 2021/0172142 | A1* | 6/2021 | Ivanov | H02K 7/063 |

FOREIGN PATENT DOCUMENTS

| | | |
|---|---|---|
| DE | 202009004301 | 12/2009 |
| DE | 202009004302 | 12/2009 |
| DE | 102011104269 | 12/2012 |
| EP | 1 267 001 | 12/2002 |

* cited by examiner

HAND-HELD WORK TOOL WITH DECOUPLED DRAWBAR CARRIER

BACKGROUND OF THE INVENTION

1. Field of the Invention

The invention relates to a hand-held work tool, in particular a work tool for soil compaction.

2. Discussion of Related Art

The work tool can be designed, in particular, as a vibration machine, in particular as a soil compaction device.

Soil compaction devices, in particular vibratory plates or vibratory rollers, are known. They essentially consist of a sub-mass with a tool, for example a soil contact element, which is moved over the soil to be compacted and is subjected to vibrations which are generated by a vibration exciter. The vibration exciter is usually an unbalance exciter, in which, for example, two counter-rotating unbalanced shafts generate a resultant force that causes the desired vibration.

Above the lower mass there is an upper mass which is movable relative to the lower mass and which has a drive, for example an internal combustion engine, a machine frame and possibly a drawbar for guiding the vibration plate. A fuel tank, a starter battery, control elements and—if available—parts of a hydraulic system are usually added to the upper mass.

Larger vibratory plates are usually controlled with the help of remote controls to protect the operator from the effects of vibrations. In the case of smaller vibration plates, a guide drawbar is usually provided, with the help of which the operator can guide and control the vibration plate. Many operators also prefer drawbars for larger vibrating plates because the directness of the control makes the control behavior easier.

Despite highly developed vibration decoupling measures between the lower mass and the upper mass, strong vibrations still act on the upper mass, which can also be transmitted accordingly to the drawbar. In order to reduce the vibrations acting on the operator guiding the drawbar, it is known, for example from DE 20 2009 004 301 U1, to divide the drawbar into a holder part and a guide part decoupled in terms of vibration from the holder part.

The internal combustion engines provided to drive the vibration generators on the upper mass can usually be started by means of electric starters with starter batteries. The starter batteries can consist, for example, of grid plate accumulators which are designed for motor vehicles for taking part in road traffic. However, the vibration amplitudes occurring in the vibration machines are in orders of magnitude higher than those occurring in normal road traffic. In practice, the problem frequently arises that the lattice structure of the vibration-sensitive starter batteries can be damaged due to the vibrations, so that the starter batteries fail.

For the vibration-decoupled mounting of a starter battery, it is known from DE 198 28 600 C1 to specify a holding device for the starter battery, on the wall of which several rubber spring elements are arranged.

Although great efforts have already been made in the prior art, to keep vibrations acting on—on the one hand—an electrical energy storage device, which, e.g., serves as a starter battery and, on the other hand, to keep vibrations acting on the operator as low as possible, acceleration values which are too high can still occur in the operation of such a work tool, which can burden the electrical load or the starter battery or the operator excessively.

SUMMARY OF THE INVENTION

The invention is therefore based on the object of specifying a hand-held work tool in which the vibrations acting on the starter battery and the operator are as low as possible.

The object is solved according to the invention by a hand-held work tool with a lower mass which has a tool and a working device for effecting a working movement of the tool, and an upper mass which is movable relative to the lower mass and which has a drive component for the work device. A first vibration decoupling device is arranged between the lower mass and the upper mass for decoupling the upper mass from the lower mass, in terms of vibration. A guide drawbar is provided for the operator to guide the work tool. The work tool further includes an electrical energy storage for providing electrical energy for the drive component. A drawbar carrier is carried by the upper mass and is connected to the upper mass by a second vibration decoupling device. The the guide drawbar is attached to the drawbar carrier, and the energy storage is carried by the drawbar carrier.

The lower mass is essentially formed by the working device and the tool. The working device can be an unbalance exciter, for example, which drives a ground contact plate serving as a tool or sets it in oscillatory motion (working motion).

The upper mass has at least one drive component which, for example, can be designed as a drive motor for the working device, in particular as an internal combustion engine. The drive component can also be designed as a control component. Increasingly, construction machines are also powered electrically by means of accumulators. The drive component can therefore also be configured as an additional battery (hereinafter also referred to as a traction battery), electric motor, voltage and/or frequency converter, electronic control and/or circuit breaker.

When referring to a drive motor, both combustion and electric motors are meant.

A fuel tank, an engine cooling device, a cooling fan, a protective frame or a centrifugal clutch can also be arranged on the upper mass, for example.

The energy storage carried by the drawbar carrier can be defined as first energy storage, wherein the drive component can have a second energy storage, which can be arranged on the upper mass. In this case, the drive motor can also be part of the drive component and thus be arranged on the upper mass. Even with a variant, the drive motor cannot be part of the drive component and can be arranged, e.g., on the lower mass, e.g., arranged directly on the working device (for example the vibrator). The second energy storage can each serve to supply the drive motor arranged on the upper mass or on the lower mass.

A transmission device can be provided to transmit the drive power of the drive motor arranged on the upper mass to the working device. This can also be, for example, a belt drive or a hydraulic coupling, for example to drive the unbalance exciter on the lower mass. The drive motor can be arranged on the upper mass, wherein its drive power can be transmitted to the lower mass with the aforementioned transmission device. Alternatively, the drive motor can be arranged on the lower mass. In this case, the use of an electric motor is preferred, which can be coupled to a vibration exciter.

The energy storage (possibly also referred to below as the first energy storage) can be, for example, a starter battery, for example for an electric starter provided on the internal combustion engine.

In a variant with an electric motor as the drive motor, the energy storage (or the first energy storage) can also be a secondary battery for providing electrical energy, for example, for control devices of the motor or also part of the traction battery supplies the electric motor with drive energy. The electric motor in this case, can be supplied with drive energy by, e.g., both energies storages, namely the first energy storage and the second energy storage. The electrical energy required for the electric motor is then stored and distributed in the two energy storages.

The drawbar carrier is connected to the upper mass via the second vibration decoupling device. The drawbar carrier can be movable relative to the upper mass within certain limits that are specified by the second vibration decoupling device.

Both vibration decoupling devices can be formed with the aid of an elastic mounting and in this way allow a relatively high degree of movability of the components coupled together (lower mass-upper mass; upper mass-drawbar carrier) in order to prevent or at least reduce the transmission of the vibrations from another component.

The first vibration decoupling device and the second vibration decoupling device are effectively connected in series between the lower mass (and thus the location where the vibrations occur) and the component to be protected (battery: guide drawbar). This adds up the vibration decoupling effect of the two vibration decoupling devices.

Because of the two vibration decoupling devices, in particular the energy storage carried by the drawbar carrier or the first energy storage (for example the battery, starter battery, traction battery, part of the traction battery) and the guide drawbar are vibrationally dependent on the actual location of the vibration generation, namely the working device in the base mass. The vibrations on the lower mass are effectively dampened or reduced by the vibration decoupling devices connected in series with respect to the battery and the guide drawbar in order to protect the battery and the guide drawbar from high vibrations. Accordingly, the operator is also protected from excessive vibrations when he grips the end of the guide drawbar to guide the work tool with his hands.

The drawbar carrier can be arranged in a region of the upper mass that faces the operator. This means that the drawbar carrier, viewed in the forward direction of travel, can be arranged in particular in the rear, i.e., the rearward part of the upper mass. Accordingly, a suitable recess for the drawbar carrier and the second vibration decoupling device must be provided in the rear part of the upper mass.

The guide drawbar can be pivotably mounted relative to the drawbar carrier. In particular, it can be achieved that the guide drawbar can optionally be pivoted upwards for a transport position or downward for an operating position. For this purpose, the guide drawbar can be attached to the drawbar carrier via a pivot bearing, for example an axis.

In the lower position of the guide drawbar (operating position) it can be advantageous if a resilient stop is provided in order to lower the guide drawbar in this lower position. The stop can be realized, for example, by a rubber or plastic buffer.

The second vibration decoupling device can have multiple connection points between the drawbar carrier and the upper dimension. On the one hand, the connection points enable reliable mechanical coupling between the drawbar carrier and the upper mass. On the other hand, they also ensure the vibration decoupling between the two components.

In one embodiment, at least four connection points can be provided between the drawbar carrier and the upper mass, three of the four connection points spanning an imaginary (virtual) plane and the fourth connection point being at a vertical distance from the plane which corresponds to at least half of the smallest distance, which the fourth connection point to the closest of the other three connection points has. Ideally, the four connection points can be arranged in a form of tetrahedron in order to achieve a particularly stable and effective arrangement in the space and to reliably hold the drawbar carrier with the guide drawbar on the upper mass.

In particular, the second vibration decoupling device must be suitable for reliably transmitting the steering and control forces which the operator applies with his hands at the end of the guide drawbar to the upper mass and thus to the lower mass. In particular, this results in tilting and torques which are introduced into the drawbar carrier by the operator via the guide drawbar and which are to be transmitted by the second vibration decoupling device. The arrangement of the four connection points ensures a broad base of moments in order to introduce the guiding forces and moments directly into the upper mass and thus into the work tool.

The fourth connection point is outside the plane spanned by the other three connection points. The distance from the fourth connection point to the plane should be as large as possible in order to make the imaginary (virtual) tetrahedron as large as possible.

In one embodiment, six connection points are provided between the drawbar carrier and the upper mass, with at least two of the six connection points being arranged at a different height level than the remaining connection points, in relation to an intended use position of the implement in a horizontal plane. In this embodiment with six connection points, it can also be achieved that connection points are arranged outside of imaginary planes, so that the advantageous tetrahedron arrangement described above can be achieved by means of four of the six connection points.

To define the height level, it is assumed that the work tool is in its horizontal use position. In this case, the difference in height can be, for example, at least 50% of the minimum distance between the remaining connection points. Here, too, it is important to pull the connection points as far apart as possible in order to achieve a broad moment base for taking up the guiding forces and moments.

The connection points can each be formed by buffer elements and can be implemented, for example, as rubber buffers or plastic buffers. The buffer elements should have at least a low elasticity in order to be able to develop the vibration-decoupling effect.

The buffer elements can each have a central axis in their longitudinal direction, the central axes of the buffer element of all connection points being able to extend in at least three different spatial directions. The buffer elements are constructed in a manner known per se and can, for example, have two spaced-apart metallic plates (sheets, disks), between which an elastic rubber or plastic element is provided. The respective forces are introduced via the plates provided at the end and elastically absorbed by the rubber or plastic element. The rubber or plastic element thus also serves as a spring and damper element.

The central axis of the buffer elements should therefore deviate from one another and extend in three different spatial directions. This means that the central axes are at an angle to each other or are skewed. Of course, it can be feasible to arrange the buffer elements in pairs so that, here as well, an absorption of the acting guiding forces can be achieved as best as possible.

The buffer elements can be arranged such that they are subjected to pressure and/or thrust during operation of the work tool, but not to tension. Accordingly, the fastenings of the buffer elements on the drawbar carrier and the upper mass must be designed in such a way that, in the event of normal force effects, the prevailing vibrations and the guiding forces brought in by the operator cannot cause a pulling effect in the buffer elements.

A protective frame can be provided which is rigidly connected to the upper mass. The protective frame then forms part of the upper mass.

In one variant, the protective frame can be rigidly connected to the drawbar carrier instead of the upper mass. In this case the protective frame is separated from the upper mass and not part of the upper mass.

The guide drawbar can have an elongated extension, a handlebar for gripping by the operator being provided at one end facing away from the upper mass or facing away from the drawbar carrier. The handlebar can not only be gripped by the operator to guide the work tool. Likewise, it is also possible to design the handlebar as a control element for setting the running direction of the work tool, for example a vibration plate. For this purpose, the handlebar can be pivoted relative to the end of the drawbar, the pivoting movement of the handle block being captured in a suitable manner and transmitted to an imbalance exciter in the under mass. The function and effect of such a vibratory plate control is known per se and should not be further elaborated on here.

The work tool can in particular be a vibration plate for soil compaction.

BRIEF DESCRIPTION OF THE DRAWINGS

These and other advantages and features of the invention are explained in more detail below using examples with the aid of figures, as follows.

DETAILED DESCRIPTION

Figure 1:
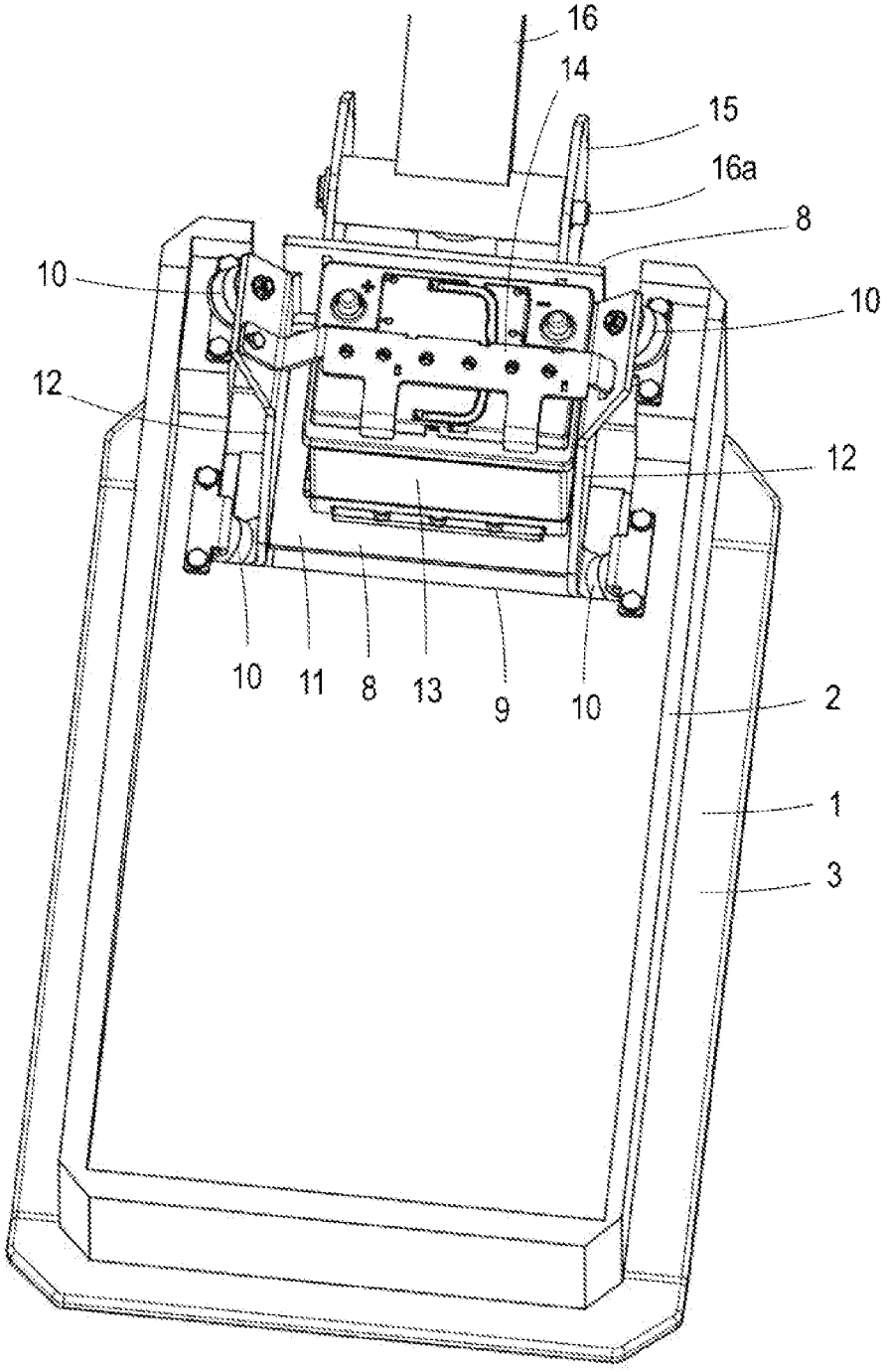
FIG. 1 shows a perspective top view of a vibrating plate serving as a work tool.
Figure 2:
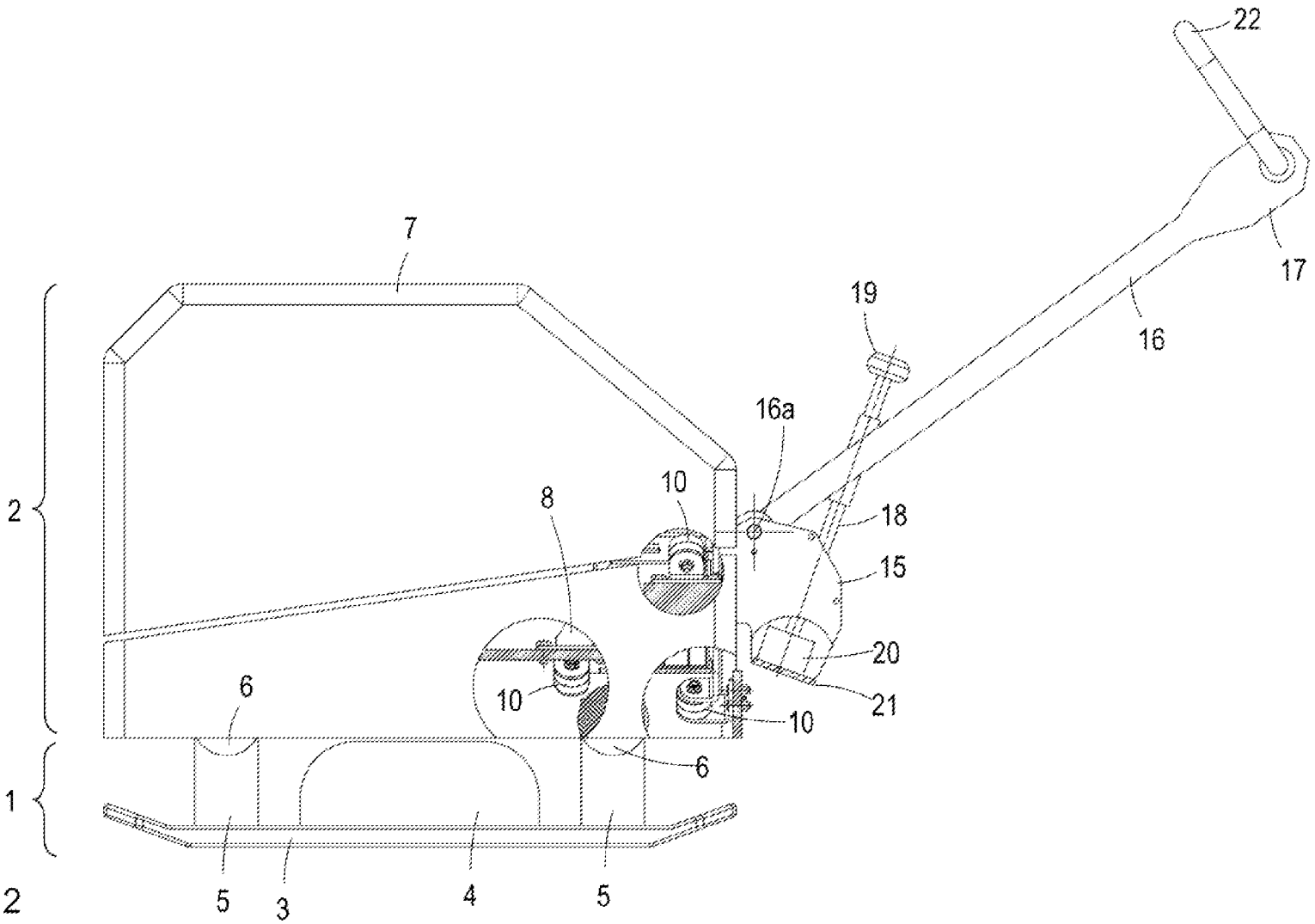
FIG. 2 is a side view of the vibration plate of FIG. 1.

FIG. 1 shows a vibration plate driven by an internal combustion engine for soil compaction as an example of a work tool according to the invention in the perspective view from above. FIG. 2 shows the vibration plate of FIG. 1 in a side view. Whereas in the representation in FIG. 2, the vibrating plate is equipped with a protective frame that will be explained later, said frame is removed from FIG. 1 for better illustration.

The vibration plate has a lower mass 1 and an upper mass 2 arranged above the lower mass 1.

A bottom contact plate 3 serving as a tool is considered to be a component of the bottom mass 1, the underside of which is moved over the soil to be compacted. A vibration exciter 4 is arranged on the ground contact plate 3 which can be designed, for example, as a known imbalance exciter. The unbalance exciter has, for example, two counter-rotating unbalanced shafts, on each of which an unbalanced mass is arranged. The resultant countervailing rotation creates a force vector that forms the desired vibration. Due to the rigid coupling between the vibration exciter 4 and the ground contact plate 3, the vibration is introduced directly into the ground contact plate 3 and can therefore be used well for soil compaction.

Fastening devices 5 are also provided on the lower mass 1, on each of which buffer elements 6 made of a rubber or plastic material are arranged. The buffer elements 6 are part of a first vibration decoupling device which decouples the upper mass 2 in terms of vibration in relation to the lower mass 1, which vibrates strongly during operation.

A protective frame 7 is arranged on the upper mass 2 as part of the upper mass 2 (FIG. 2), which, however—as mentioned above—is not shown in FIG. 1.

A drive motor (not shown) for driving the vibration generator 4 is also considered to be part of the upper mass 2. In particular, this can be an internal combustion engine. However, it is also possible to implement the drive motor as an electric motor.

To transmit the drive power of the drive motor to the vibration exciter 4, a transmission device, also not shown, is further provided, which can be implemented, for example, as a belt drive or as a hydraulic drive.

The other components can also be included in the upper mass 2: for example, a fuel tank, control components, engine cooler, cooling fan, a centrifugal clutch, a protective frame.

A drawbar carrier 8 is held at upper mass 2. For this purpose, a corresponding section 9 can be formed in the upper mass, into which the drawbar carrier 8 is inserted (FIG. 1).

Figure 3:
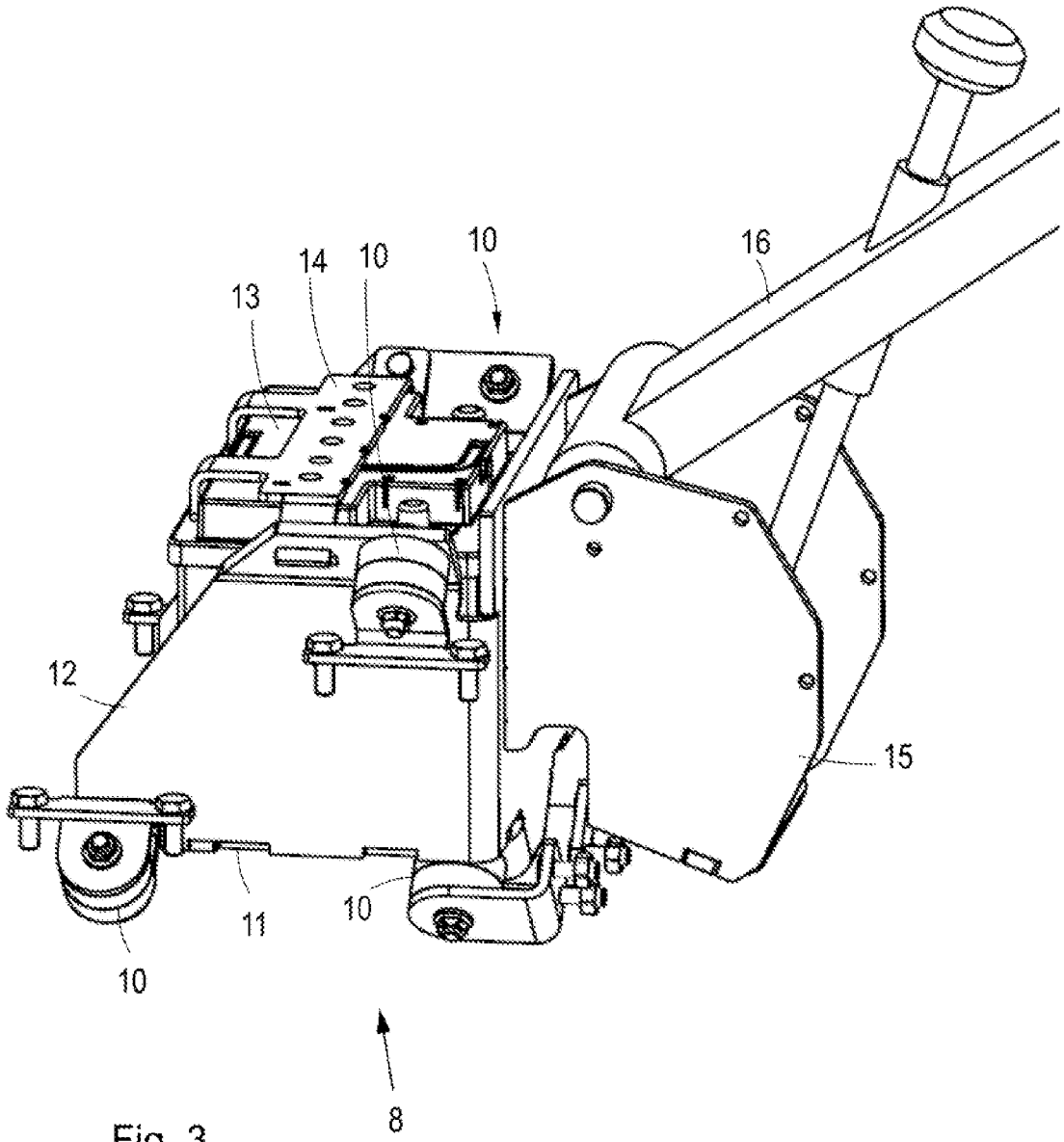
FIG. 3 shows a perspective partial view of a drawbar carrier with a guide drawbar.

FIG. 3 shows the drawbar carrier 8 attached to the upper mass 2 in a perspective partial view.

The drawbar carrier 8 is decoupled from the upper mass 2 in terms of vibration. For this purpose, a second vibration decoupling device is provided between the drawbar carrier 8 and the upper mass 2, which has multiple buffer elements 10. For the vibration plate shown as an example in FIGS. 1 to 3, a total of six buffer elements 10 are arranged between the upper mass 2 and the drawbar carrier 8. The buffer elements 10 are shown in respective cutaway drawings in FIG. 2.

Each of these buffer elements 10 has a plate (sheet, disc, etc.) on the front-end. The actual buffer material, for example a rubber or plastic material, is arranged between the two front-end plates. Basically, the buffer elements 10 can have a similar design as the buffer elements 6 between the upper mass 2 and the lower mass 1. These are generally components that are available on the open market and commercially available, for example rubber buffers.

The respective central axis of the buffer elements 10 are arranged on one side of the drawbar carrier 8 and are spaced apart from one another, as shown in FIGS. 1 to 3. The respective central axis of the buffer elements 10 extend in different spatial directions, as is clearly visible in the FIGS. 1 to 3, as well. In this way, different preferred directions of action of the buffer elements 10 are achieved in order to preferably subject the buffer elements 10 to pressure or thrust (or torsion), only, but not to tension.

The drawbar carrier 8 is box-shaped and has a plateau-shaped area 11 which is delimited by side walls 12 (FIG. 3).

A battery 13 is set up on the plateau-shaped area 11, the position of which is fixed by a locking element 14. In this way, the battery 13 is reliably held in its position even when the vibration plate is in operation. The battery 13 is used in particular to store and provide electrical energy which, if necessary, can be supplied to an electric starter provided on the drive motor. In addition, further control devices of the vibration plate can be supplied with electrical energy from the battery 13.

If the drive motor is implemented as an electric motor in a variant, the battery 13 can also serve as part of a traction battery which supplies the electric motor with the necessary electrical drive energy. Another part of the traction battery can be provided directly on the upper mass as drawbar carrier 8, which is not—as in the battery 13—decoupled in terms of vibration from the upper mass.

Because the battery 13 is mounted on the drawbar carrier 8, it is effectively decoupled from the vibrations in the lower mass 1 in terms of vibrations. The vibrations in the lower mass 1 are considerably reduced due to the first vibration decoupling device (buffer elements 6) and second vibration decoupling device (buffer elements 10) connected in series with respect to the battery 13 and the drawbar carrier 8, so that the battery 13 is well protected.

On the drawbar carrier 8, a drawbar receptacle 15 is provided in the rearward area, on which a guide drawbar 16 is pivotally mounted. The lower end of the guide drawbar 16 is fastened to the drawbar receptacle 15 with its lower end and can be pivoted between an upper position and a lower position shown in the figures about a pivot axis 16*a* if the operator pushes a drawbar head 17 formed at the end of the guide drawbar 16 up or down.

A stop device 18 with a height adjustment 19 is provided on the guide drawbar 16. A buffer element 20 is arranged at the lower end of the stop device 18 which element can be stopped against a stop 21 formed on the drawbar receptacle 15 when the guide drawbar 16 is in the lower position shown in FIG. 2.

With the help of the height adjustment 19, the angle of the guide drawbar 16 can be adjusted in the lower position relative to the drawbar receptacle 15 and thus the remaining vibrating plate in order to adjust the drawbar head 17 to a comfortable height for the body size of the operator.

A handlebar 22, which also serves as a switch bracket, is arranged on the drawbar head 17. Accordingly, the sturdy handlebar 22 can be gripped by the operator, on the one hand, in order to apply corresponding forces to the vibrating plate and to control and steer it. In addition, the handlebar 22—if it is also designed as a switch bracket—can be pivoted relative to the drawbar head 17. The pivoting of the handlebar 22 is detected by a transmission device, not shown, and transmitted to the vibration exciter 4. In particular, a hydraulic transmission device can be provided, with the aid of which the relative position of the unbalanced shafts in the vibration exciter 4 and thus the phase bearing thereof can be changed so as to adjust the direction of the resulting vibration vector and thus the direction of travel.

In this way, a forward and backward travel of the vibration plate can be realized. The vibrating plate can also implement a stationary vibration when in standstill. The control options described have been known for a long time and therefore do not need to be explained in more detail here.

Figure 4:
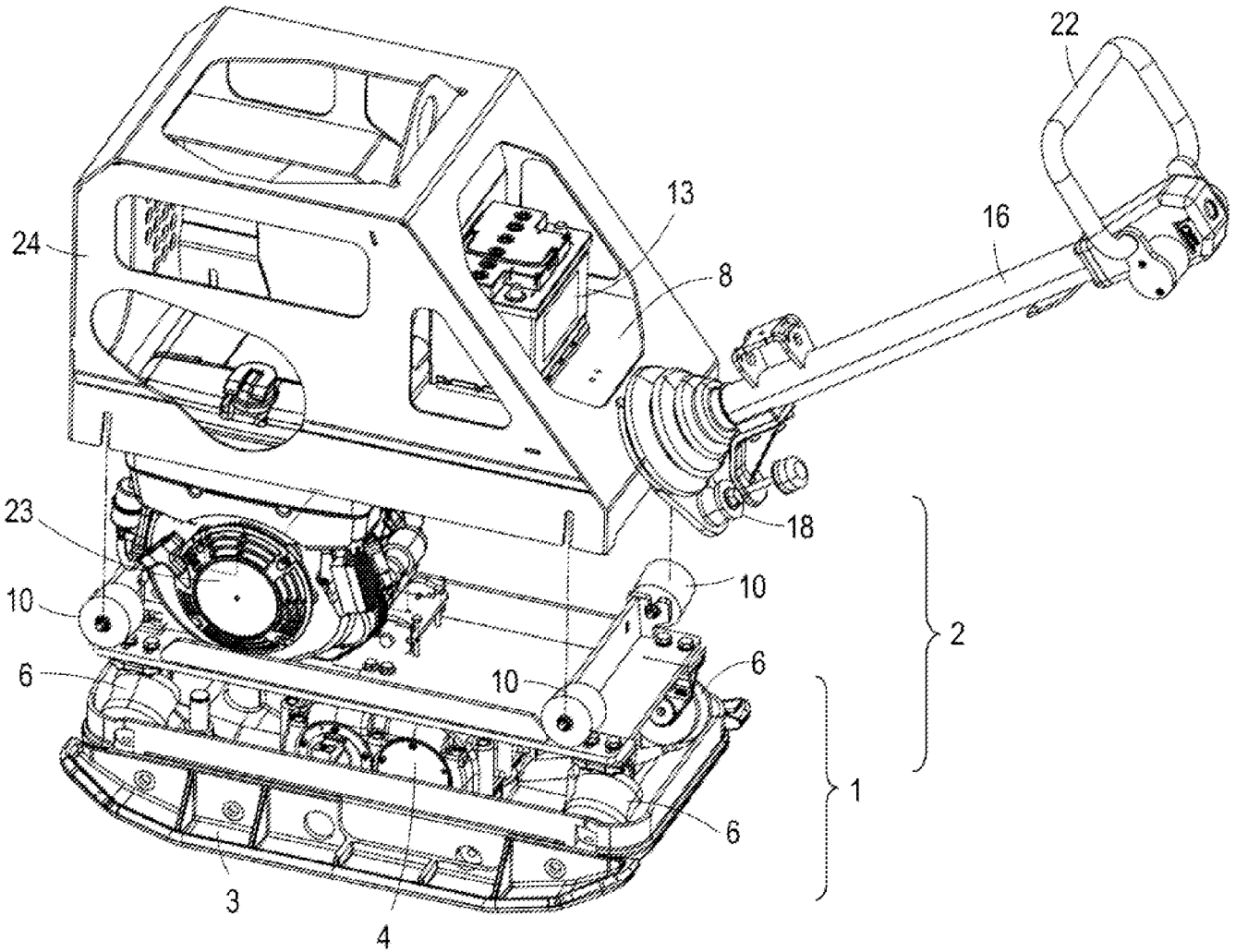
FIG. 4 shows a variant of the vibrating plate from FIG. 2

FIG. 4 shows another embodiment of a vibrating plate serving as a working device according to the invention.

As far as similar or structurally identical components are used, as in the embodiment of FIGS. 1 to 3, the same reference numerals are used.

This vibration plate also has a lower mass 1 and an upper mass 2, a first vibration decoupling device in the form of the buffer elements 6 being provided between the lower mass 1 and the upper mass 2, in terms of operation.

On the upper mass 2, a drive motor 23 is also attached and shown in FIG. 4.

In this variant, the drawbar carrier 8 is designed to be significantly larger and extends over the entire base area of the upper mass 2, with cutouts also being possible. Accordingly, the drawbar carrier 8 is decoupled in terms of vibration from the upper mass 2 via the buffer elements 10, which serve as a second vibration decoupling device.

In addition, a protective frame 24 is carried by the drawbar carrier which spans the vibration plate in a housing-like manner in a manner known per se. The protective frame 7 shown in FIGS. 1 to 3 is thus replaced by the protective arm.

Due to the fact that the protective frame 24 is part of the drawbar carrier 8 or is rigidly attached to it, the total mass of the drawbar carrier 8 is increased, whereby the effect of the vibration reduction is further intensified. Accordingly, it is possible to considerably reduce the vibrations acting on the battery 13 supported by the drawbar carrier 8. The guide drawbar 16 is also held by the drawbar carrier 8, so that the vibrations (hand-arm vibrations) transmitted to the operator via the guide drawbar 16 can also be kept small.

In a further embodiment, not shown, the battery 13 is an element of an electrical drive of the work tool. The electrical drive energy can be provided by means of a traction battery arranged on the upper mass and can be provided to the battery 13. To this extent, the battery 13 can form part of the traction battery or support it. The energy of the traction battery and battery 13 can, for example, be combined in order to provide a higher overall capacity. Alternatively, it is also conceivable to supply the electronic control with the battery 13 and to supply the electric drive motor by means of the traction battery, i.e., to assign separate tasks to both batteries. In this case, the battery 13 can also be referred to as a secondary battery, since it serves to provide energy for secondary tasks that is not directly required to operate the electric motor.

We claim:

1. A hand-held work tool, comprising:

a lower mass which has a tool and a working device for causing a working movement of the tool;

an upper mass which is movable relative to the lower mass and which has a drive component for the working device;

a first vibration decoupling device, arranged between the lower mass and the upper mass, for decoupling the upper mass from the lower mass in terms of vibration;

a guide drawbar for guiding the work tool by an operator;

an electrical energy storage which provides electrical energy for the drive component; and a drawbar carrier which is carried by the upper mass and which is connected to the upper mass via a second vibration decoupling device; wherein the guide drawbar is attached to the drawbar carrier; and wherein the energy storage is mounted on the drawbar carrier.

2. The work tool according to claim 1, wherein the working component has a drive motor for the working device.

3. The work tool according to claim 1, wherein the energy storage that is carried by the drawbar carrier is a first energy storage; and wherein the drive component has a second energy storage which is arranged on the upper mass.

4. The work tool according to claim 1, wherein the drawbar carrier is arranged in a region of the upper mass which is facing an operator.

5. The work tool according to claim 1, wherein the guide drawbar is pivotally mounted relative to the drawbar carrier.

6. The work tool according to claim 1, wherein the second vibration decoupling device has multiple connection points between the drawbar carrier and the upper mass.

7. The work tool according to claim 1, wherein at least four connection points are provided between the drawbar carrier and the upper mass; and wherein three of the four connection points span an imaginary plane, and the fourth connection point has a vertical distance from the plane which corresponds at least to half the smallest distance that the fourth connection point has from the closest of the other three connection points.

8. The work tool according to claim 1, wherein six connection points are provided between the drawbar carrier and the upper mass; and wherein at least two of the six connection points are arranged at a different height plane than the remaining connection points, based on a provided use position of the work tool in a horizontal plane.

9. The work tool according to claim 1, wherein the connection points are each formed by buffer elements.

10. The work tool according to claim 9, wherein the buffer elements each have a central axis in their longest direction; and wherein the central axis of the buffer elements of all connection points extend in at least three different spatial directions.

11. The work tool according to claim 1, wherein the buffer elements are arranged in such a way that they are subjected to pressure and/or thrust during operation of the work tool, but not to tension.

12. The work tool according to claim 1, further comprising a protective frame is which is connected with the upper mass or with the drawbar carrier.

13. The work tool according to claim 1, wherein—the guide drawbar has an elongated extension; and wherein a handle bracket for—a handlebar for gripping by the operator is provided at one end of the extension facing away from the upper mass.

14. The work tool according to claim 1, wherein the work tool is a vibrating plate for soil compaction.

* * * * *